US005244410A

United States Patent [19]

Demus et al.

[11] Patent Number: 5,244,410

[45] Date of Patent: Sep. 14, 1993

[54] ELECTRICAL CONNECTION SYSTEM FOR FLAT CABLE

[75] Inventors: Louis Demus, Vernet Pessac; Gérard Gaonac'H, La Teste; Jean-Marc Sinai, Bordeaux, all of France

[73] Assignee: Commissariat A L'Energie Atomique, France

[21] Appl. No.: 946,957

[22] Filed: Sep. 17, 1992

[30] Foreign Application Priority Data

Sep. 25, 1991 [FR] France ..... 91 11800

[51] Int. Cl.[5] ..... H01R 9/07

[52] U.S. Cl. ..... 439/497; 439/736

[58] Field of Search ..... 439/578–585, 439/63, 67, 77, 492, 494–497, 56, 736, 722, 916

[56] References Cited

U.S. PATENT DOCUMENTS

| | | | |
|---|---|---|---|
| 3,564,478 | 2/1971 | Hampton | 439/581 |
| 3,999,821 | 12/1976 | Yurtin | 439/495 |
| 4,526,432 | 7/1985 | Cronin et al. . | |
| 4,636,015 | 1/1987 | Ford, Jr. | 439/916 |
| 5,044,963 | 9/1991 | Kukkonen et al. | 439/63 |
| 5,134,252 | 7/1992 | Himeno et al. | 439/497 |

FOREIGN PATENT DOCUMENTS

| | | | |
|---|---|---|---|
| 0069102 | 1/1983 | European Pat. Off. . | |
| 1541670 | 9/1966 | Fed. Rep. of Germany . | |
| 2601826 | 1/1988 | France | 439/492 |

*Primary Examiner*—David L. Pirlot
*Attorney, Agent, or Firm*—Pearne, Gordon, McCoy & Granger

[57] ABSTRACT

The connection system permits an easy fixing of a flat cable (1) to a connector (20). The flat cable (1) has a central contact end (12A) terminating a conductive plate (12) and surrounded by an earth contact end (14A) extending an earth plate (14). The flat cable is coated with an insulant. These ends are fixed to the connector (20) by means of a potted cap (21), which is fitted by pressure. The position of the flat cable (1) can be of a random nature around the connector (20). Application to high voltage connections in a severe environment and to low voltage connections with or without shielding.

4 Claims, 2 Drawing Sheets

FIG. 3
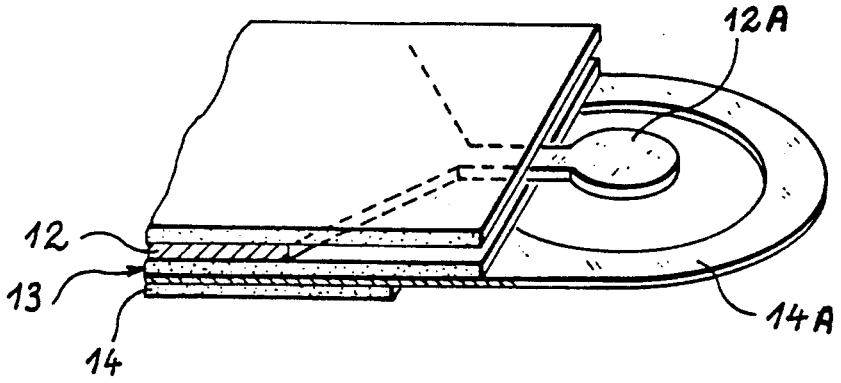
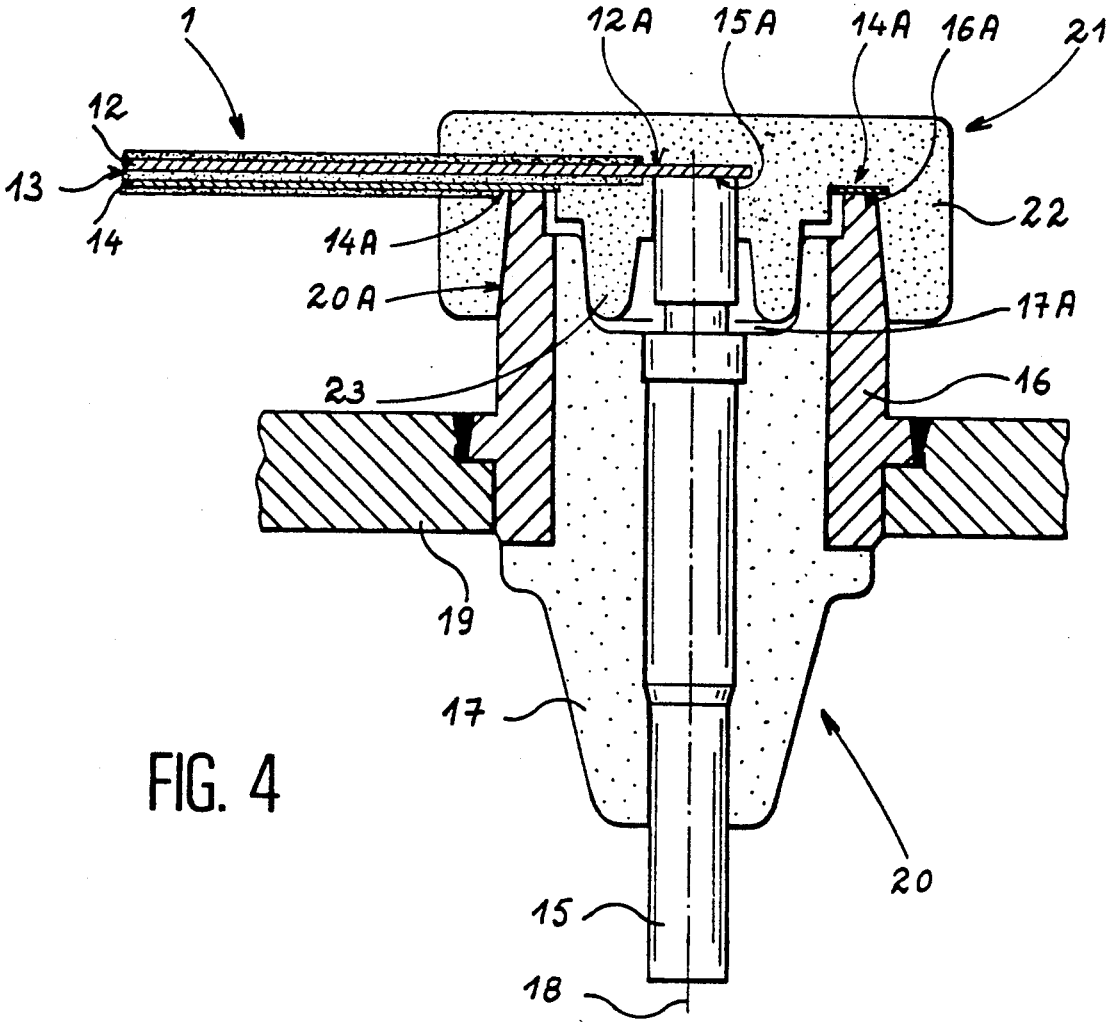
FIG. 4

ELECTRICAL CONNECTION SYSTEM FOR FLAT CABLE

FIELD OF THE INVENTION

The invention relates to electrical connections between a flat cable incorporating one or more conductors and one or more fixed connectors. The invention more particularly applies to multiple conductor cables for producing detachable connections.

PRIOR ART AND SET PROBLEM

French patent 2 356 247 discloses a flat cable for detachable connections. As shown in FIG. 1, said flat cables comprise several reciprocally spaced metal conductors 2. They are preferably sandwiched between two insulating coatings 3 and 4. Each conductor 2 comprises a flexible central part 5 and two rigid ends 6, 7. These conductors 2 have dimensions and shapes corresponding to the use to be made of them.

As can be seen in FIGS. 1 and 2, the ends 6 and 7 can be shaped and profiled differently as a function of the connection to be made to a connector 8, 9. Thus, the ends 6 can be bent at right angles with a view to their introduction into openings 10 of a connector 8, which can be a circuit board. The ends 7 can be bent and fashioned with a view to a connection to a connector 9 in order to form welds 11.

The relative flexibility of the central part 5 of the flat cable makes it possible to provide detachable connections. However, such cables do not make it possible to produce connections except when the contacts of said connectors are welded or crimped. Thus, in order to obtain a complete connector, it is necessary to add a connection system coupled to the cables by welding or crimping.

The object of the invention is to obviate this disadvantage by proposing a different design for the connections.

SUMMARY OF THE INVENTION

To this end, the main object of the invention is an electrical connection system for a flat cable having an earth or ground and comprising at least one flat cable having a central part and two ends and a connector to which is to be connected the first end of the flat cable.

According to the invention, at least one cable end comprises a central conductive contact end with a flat, reduced surface, a flat, ring-shaped earth or ground contact end surrounding said conductive end and leaving a space between it and the conductive end and means for fixing the cable end to the connector.

The invention more particularly applies to a flat cable having an earth constituted by a metal plate connected to the earth end and a conductive part constituted by a metal plate connected to the conductive end, said two plates being separated by an insulator.

According to a feature of the invention, the plates are thicker at their contact end than in the central part of the cable.

The connector preferably comprises a central rod with a central contact surface having a shape corresponding to the conductive end for receiving the latter, an outer ring with an upper contact surface having a shape corresponding to the earth end for receiving the latter and an insulating part separating the central rod from the outer ring and to which are fixed said two members.

In this case, the fixing means comprise a toroidal cavity having a given shape and constituted by the outer ring, the central rod and the insulating part, with a release or clearance to permit the introduction of a member and a potted cap having on one side shapes complimentary to those of the toroidal cavity of the connector and edges surrounding the outer ring, so as to be fixable to the connector by pressure and in this way fixing the cable to the connector. Thus, no matter what the possible orientation of the cable, an operator can carry out fixing without even observing the operation which he is performing.

LIST OF DRAWINGS

The invention is described in greater detail hereinafter relative to non-limitative embodiments and with reference to the attached drawings, wherein show:

FIG. 1—A flat cable according to the prior art.

FIG. 2—The same prior art cable in profile view, FIGS. 1 and 2 already having been described.

FIG. 3—An end of a flat cable according to the invention.

FIG. 4—In frontal section, the connection system according to the invention.

DETAILED DESCRIPTION OF AN EMBODIMENT OF THE INVENTION

Figure 1:
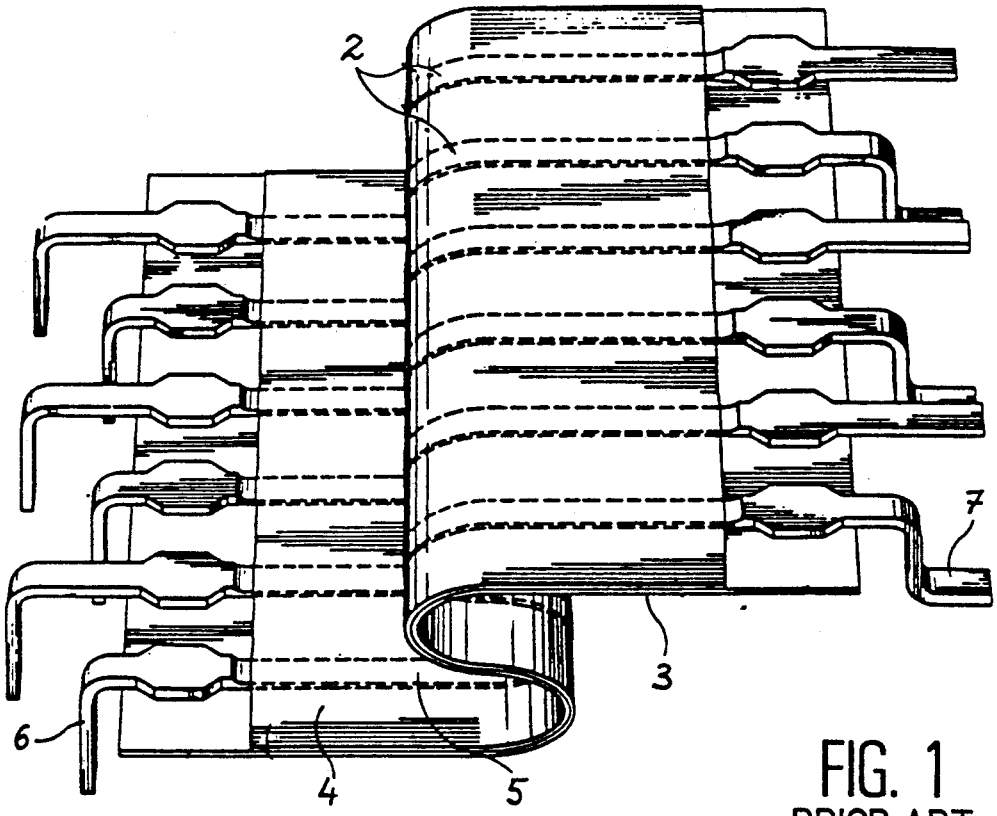
FIG. 1 PRIOR ART
Figure 2:
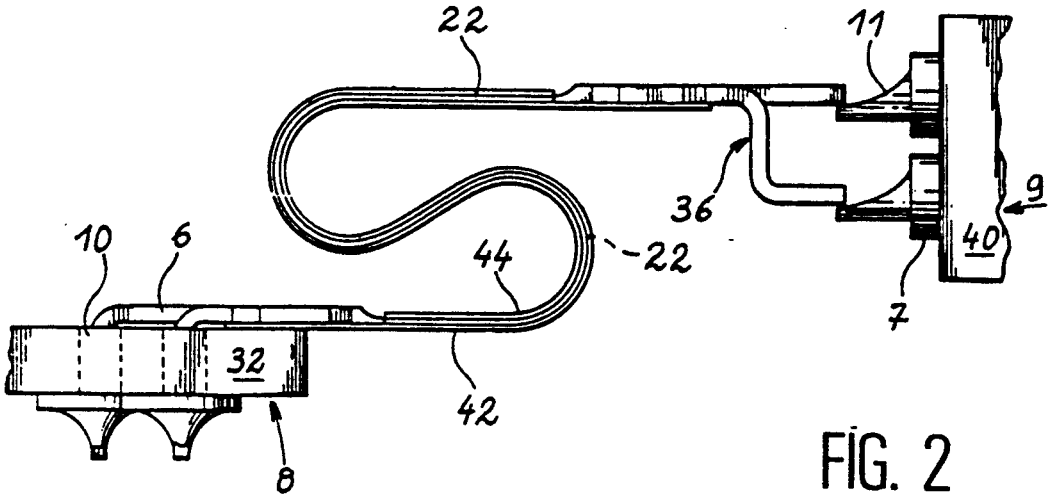
FIG. 2 PRIOR ART

The end of the flat cable 1 shown in FIG. 3 essentially comprises three members, namely a metallic current conductor 12, a metallic earth or ground conductor 14 and an insulator 13.

The metallic current conductor 12 is a metal plate, whose end 12A is narrowed in order to form an e.g. round, small contact surface. This shape is given in exemplified manner, but has no functional significance.

The earth conductor 14 is a metal plate, whose end 14A surrounds the end 12A of the conductors 12, whilst leaving a space between said two members, so that there is no possibility of contact between the two ends.

FIG. 4 better shows the structure of the flat cable 1 according to the invention. The current conductor 12 and the earth conductor 14 are two superimposed metal plates, which are separated by an insulator 13. Preferably, two insulators are also positioned around these two members in such a way as to surround them. The insulator is absent from the end 12A of the current conductor 12 and the end 14A of the earth conductor 14, so as to permit contact between said two members and a connector.

The ends 12A and 14A are placed in the extension of their respective metal plates 12 and 14. This only constitutes one embodiment, the vertical position of said two ends 12A and 14A being modifiable as a function of the configuration of the connector and the cap. It should be noted that it is preferable for said ends 12A and 14A to be thicker than their respective metal plates 12 and 14 of the central portion of the flat cable.

With reference to FIG. 4, the connector is preferably constituted by a central rod 15, an outer ring 16 and an insulator 17. The central rod 15 is centred in the centre of the connector along a vertical axis 18 of the latter. It is terminated at its upper end by a contact surface 15A for receiving the conductive contact end 12A of the cable. Its shape preferably corresponds to the shape of said conductive contact end 12A.

In the same way, the outer ring 16 is terminated at its upper end by a ring-shaped contact surface 16A corresponding to the shape of the earth contact end 14A. The respective vertical positions of the contact surfaces 15A and 16A correspond with the respective vertical positions of the contact ends 12A and 14A of the flat cable 1.

The insulator 17 maintains the spacing between the central rod 15 and the outer ring 16. However, in its upper portion, said insulating member 17 has a shape that it permits the definition with the aid of the central rod 15 and the outer ring 16 of a cavity 17A separating the contact surfaces 15A and 16A.

The complete connector is fixed on an equipment wall 19, e.g. as a result of the outer shape of the outer ring, said fixing being possible by welding.

FIG. 4 also shows a preferably potted cap 21, whose lower surface shape corresponds to the upper shape of the connector 20. In other words, the said shape constituted by annular projecting portions 22, 23 is complimentary to that of the connector 20 and in particular the shape defined by the contact surfaces 15A, 16A and by the cavity 17A.

The potted cap 21 is clearly intended to be fixed to the connector 20 by the introduction of the projecting portions 22, 23 into the cavity 17A of the connector 20 and round the latter. To permit this penetration and the maintaining of the cap 21 on the connector 20, the latter is made from a slightly deformable plastics material. The cap can e.g. be made from an elastomeric material. Potting takes place directly on the end of the flat cable 1 or on a model having an identical shape. Moreover, the shape of the portions penetrating on the connector 20 is such that there is a slight clearance on the side walls of said portions 22, 23 to permit the introduction of the cap 21 onto the connector 20. Coorespondingly, the cavity 17A and the upper outer surface 20A of the connector 20 are also slightly inclined corresponding to the inclination of the shapes of the cap 21 to permit the penetration of the latter on the connector 20. This is only an embodiment, the principle of fixing the cap 21 to the connector 20 being an elastic locking action, preferably a conical fitting together, such as is e.g. the case with mineral water bottle caps.

In order that the flat cable 1 can have access to the centre of the cap 21, the outer wall 22 of the latter is notched over a width equivalent to the width of the flat cable 1. This also applies with respect to the inner portion 23, which is notched over a relatively small width of the metal plate connecting the central portion of the conductor 12 to its contact end 12A.

FIG. 4 shows the installation of the assembly once the cable 1 has been fixed to the connector 20 by means of the cap 21. It can be seen that the latter is entirely engaged on the connector 20, the inner portion 23 of the cap 21 penetrating the cavity 17A, the outer portion 22 of the cap 21 surrounding the outer surface 16A of the ring 16. Thus, the flat cable 1 is in contact by its conductive contact end 12A with the contact surface 15A of the central rod 15 and by its earth contact end 14A with the upper surface 16A of the ring 16.

This electrical connection design offers certain advantages. There is no need for screwing or welding for bringing about the connection and fixing of the flat cable 1 to the connector 20. The conductive portion 12 and its contact end 12A on the one hand and the earth or ground portion 14 and its contact end 14A on the other are produced monolithically.

In the embodiment shown in the drawings, the connections are made in the same plane as the cable layer, i.e. in the same respective planes of the plates constituting the conductive portion 12 and the earth portion 14, which reduces the overall dimensions of the connection.

Locking by elastic plugging in of the cap 20 permits the making of a "blind" connection, i.e. the operator does not have to observe the operation which he is carrying out, which makes it easier to produce the connection. The flat cable 1 can have a random orientation on the connector 20, i.e. the flat cable can be positioned over 360°.

The contact by bearing carried out by the cap 21 offers a spring effect on the central conductive contact end 12A, which ensures a good behaviour of the connection with respect to vibrations.

The potted cap 21 makes it possible to lengthen the high voltage leakage paths in order to obtain an acceptable dielectric behaviour at voltages over 2 kV. The cap 21 also significantly contributes to the mechanical behaviour of the connection assembly.

Thus, the connection system according to the invention leads to a reliable, simple, cabling-free, high voltage connection with very samll overall dimensions and permitting a blind connection. The invention is applicable to high voltage connections in a severe environment and to low voltage connections with or without shielding.

We claim:

1. Electrical connection system for a flat cable with an earth conductor comprising at least one flat cable (1) having a central portion and two ends, and a connector (20) which is to be connected to the first end of the flat cable (1), characterized in that the first end of the flat cable (1) comprises a central, conductive contact end (12A) having a flat, reduced surface; and a flat, ring-shaped, earth contact end (14A) surrounding the conductive contact end (12A) and spaced from the conductive contact end (12A); and further characterized in that the connector comprises a toroidal cavity (17A) defined by an outer ring (16), a central rod (15), and an insulating member (17) having a specific shape; and a potted cap (21) having on one side shapes (22, 23) complimentary to those of the toroidal cavity (17A) and the outer ring of the connector (20), respectively, and surrounding the outer ring (16), so as to be fixable to the connector (20) by pressure to fix the cable (1) to the connector (20).

2. Connection system according to claim 1, characterized in that the central rod (15) includes a central contact surface (15A) having a shape corresponding to the conductive contact end (12A) for receiving the conductive contact end; the outer ring (16) includes an outer contact surface (16A) having a shape corresponding to the earth contact end (14A) for receiving the earth contact end; and the insulating member (17A) separates the central rod (15) and the outer ring (16) and to which said rod and ring are fixed.

3. Connection system according to claim 1, characterized in that the flat cable (1) comprises an earth conductor (14) constituted by a metal plate connected to the earth contact end (14A) and a conductive portion (12) constituted by a metal plate connected to the conductive contact end (12A), said two plates (12, 14) being separated by an insulator (13).

4. Connection system according to claim 3, characterized in that the plates (12, 14) are thicker at their contact ends (12A, 13A) than in the central portion of the cable.

* * * * *